US009695526B2

(12) United States Patent
Nägeli et al.

(10) Patent No.: US 9,695,526 B2
(45) Date of Patent: Jul. 4, 2017

(54) SUPPORT ELEMENT FOR A COMPACTING DEVICE FOR A DRAWING SYSTEM IN A SPINNING MACHINE

(71) Applicant: Maschinenfabrik Rieter AG, Winterthur (CH)

(72) Inventors: Robert Nägeli, Kleinandelfingen (CH); Ludek Malina, Kloten (CH); Gabriel Schneider, Winterthur (CH); Radek Zarecky, Ceska Trebova (CZ); Petr Blazek, Chocen (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 157 days.

(21) Appl. No.: 14/386,162

(22) PCT Filed: Mar. 8, 2013

(86) PCT No.: PCT/IB2013/000320
§ 371 (c)(1),
(2) Date: Sep. 18, 2014

(87) PCT Pub. No.: WO2013/140215
PCT Pub. Date: Sep. 26, 2013

(65) Prior Publication Data

US 2015/0027098 A1 Jan. 29, 2015

(30) Foreign Application Priority Data

Mar. 21, 2012 (CH) ..... 00392/12

(51) Int. Cl.
*D01H 5/72* (2006.01)
*D01H 5/22* (2006.01)
*D01H 5/74* (2006.01)

(52) U.S. Cl.
CPC ..... *D01H 5/72* (2013.01); *D01H 5/22* (2013.01); *D01H 5/74* (2013.01)

(58) Field of Classification Search
CPC ..... D01H 5/22; D01H 5/72; D01H 5/74
See application file for complete search history.

(56) References Cited

U.S. PATENT DOCUMENTS 6,108,873 A 8/2000 Barauke
6,131,382 A * 10/2000 Dinkelmann ..... D01H 1/025 57/315

(Continued)

FOREIGN PATENT DOCUMENTS

CN 1712588 A 12/2005
CN 2851298 Y 12/2006

(Continued)

OTHER PUBLICATIONS

PCT Search Report, Jul. 12, 2013.
Chinese Patent Office Search Report, Dec. 23, 2015.

*Primary Examiner* — Shaun R Hurley
(74) *Attorney, Agent, or Firm* — Dority & Manning, P.A.

(57) ABSTRACT

A support element for a compacting device for two drawing system units of a spinning machine disposed next to each other, includes a suction channel that extends inside the support element and is connected to a suction zone of suction drums via openings of suction inserts. The end faces of the suction drums are open at one end and are disposed coaxially opposite each other at a distance. The suction drums are rotatably mounted on a shaft that is attached to the support element. The support element is formed from two half shells that form the suction channel and are connected to each other by way of attachment means, wherein each of the half shells has an outwardly projecting tubular suction insert. The suction inserts are disposed coaxially opposite each other, and each suction insert has at least one bearing (Continued)

element that is provided with a passage and has at least one brace, by way of which the shaft is held in the radial direction.

15 Claims, 3 Drawing Sheets

(56) References Cited

U.S. PATENT DOCUMENTS

| | | | | |
|---|---|---|---|---|
| 6,131,383 | A | 10/2000 | Dinkelmann et al. | |
| 6,298,523 | B1 | 10/2001 | Stahlecker | |
| 9,127,378 | B2 * | 9/2015 | Schneider | D01H 5/72 |
| 9,228,277 | B2 * | 1/2016 | Schneider | D01H 5/72 |
| 9,347,151 | B2 * | 5/2016 | Malina | D01H 5/74 |
| 9,353,464 | B2 * | 5/2016 | Schneider | D01H 5/72 |
| 2001/0020357 | A1 | 9/2001 | Dinkelmann et al. | |
| 2013/0239369 | A1 * | 9/2013 | Schneider | D01H 5/72 19/246 |
| 2013/0239721 | A1 * | 9/2013 | Schneider | D01H 5/72 74/412 R |
| 2014/0157551 | A1 * | 6/2014 | Malina | D01H 5/74 19/263 |
| 2014/0157749 | A1 * | 6/2014 | Schneider | D01H 5/72 57/315 |

FOREIGN PATENT DOCUMENTS

| | | | |
|---|---|---|---|
| CN | 100 430 536 | C | 11/2008 |
| CN | 101 333 715 | A | 12/2008 |
| CN | 101613896 | | 12/2009 |
| CN | 101 666 000 | A | 3/2010 |
| DE | 197 26 694 | A1 | 4/1998 |
| DE | 199 40 817 | A1 | 3/2001 |
| DE | 199 55 525 | A1 | 5/2001 |
| DE | 100 18 480 | A1 | 10/2001 |
| DE | 102 27 463 | C1 | 10/2003 |
| DE | 10 2005 010 903 | A1 | 9/2005 |
| DE | 10 2010 054 850 | A1 | 6/2011 |
| EP | 1 612 309 | A2 | 1/2006 |
| WO | WO 2010/143098 | A1 | 12/2010 |

* cited by examiner

SUPPORT ELEMENT FOR A COMPACTING DEVICE FOR A DRAWING SYSTEM IN A SPINNING MACHINE

FIELD OF THE INVENTION

The invention relates to a support element for a compacting device for two drawing system units of a spinning machine which are disposed next to each other.

BACKGROUND

A variety of designs are already known in practice, wherein a compacting device is connected downstream for compacting (condensing) the fiber material (fiber strand) discharged from the drawing system unit. Subsequent to such a compacting device, the condensed fiber material is fed to a twist generation device after passing a clamping point. In the case of a ring spinning machine, for example, such a twist generation device is composed of a traveler revolving on a ring, wherein the generated yarn is wound onto a rotating tube. Suctioned revolving, perforated suction drums or revolving aprons provided with perforations are essentially used as compacting units. Using appropriate inserts inside the suction drum, or inside the revolving aprons, a special suction area is defined on the compacting element. Such inserts can be provided with appropriately shaped suction slots, for example, to which a negative pressure is applied, whereby a corresponding air current is generated at the periphery of the respective compacting element. In particular, protruding fibers are integrated into the yarn as a result of this air current, which is oriented substantially transversely to the transport direction of the fiber material.

In the known approaches, the fiber material discharged from the drawing system unit is guided above, or also below, the compacting devices that are used. In particular, for use on a ring spinning machine, it is necessary to provide an additional clamping point downstream of the suction zone so as to obtain a twist stop.

Such devices have been shown and described, for example, in the publications EP 947 614 B1, DE 10 2005 010 903 A1, DE 198 46 268 C2, EP 1 612 309 B1, DE 100 18 480 A1 and CN 1712588 A. These cited publications essentially involve fixedly installed compacting units, which are fixedly installed downstream of the respective drawing system. These compacting units are in part driven by way of special drive shafts, which are disposed over the length of the spinning machine and which are in driving engagement with either a suction roller or a revolving apron, or by way of a fixedly installed drive connection to appropriately disposed pressure rollers of the compacting unit.

In practice, it is necessary to retrofit existing spinning machines comprising a conventional drawing system unit with such a compacting device so as to ensure the possibility of producing high-quality yarns with these machines as well. Therefore, devices have been proposed by way of which conventional drawing systems can be retrofitted with such a compacting device. One such example can be found in DE 102 27 463 C1, for example, wherein the roller stand of the drawing system unit is extended in order to mount an additional drive roller provided for driving the retrofitted compacting device, which is likewise disposed on this extension. The drive roller extends over the entire length of the spinning machine. Attaching and installing such a retrofit unit is very time-consuming and inflexible. This means that desired dismantling to a standard drawing system without a compacting device is, in turn, very time-consuming.

A design is known from CN 101613896 A in which an additional element is screwed to the roller stand to extend the roller stand of the drawing system. Moreover, the publication DE 100 50 089 C2 shows a design comprising a compacting device that is provided for subsequent attachment to a conventional drawing system unit.

A device is known from CN 2 851 298 Y in which a compacting roller, together with a twist stop roller, is accommodated in a bearing element, which is connected by way of a plate to a pivotable weighting arm of a drawing system device via screws. In the mounted and locked position, the driving motion is transmitted via friction from a delivery roller connected directly to a drive and the pressure roller associated with the delivery roller to the compacting roller and the twist stop roller. The compacting device shown here is likewise provided for subsequent installation on existing drawing system units of spinning machines having no condensing. The compacting unit shown here is attached to an existing drawing system unit by way of a screw connection, and threading on the axle of the pressure roller is relatively time-consuming and requires an additional adjustment of the distances. The connection to a negative pressure source likewise must be established separately.

In the above-described designs, the suction elements that are associated with a defined compacting region for condensing the fiber material are subjected to a negative pressure by way of additionally disposed pipes, which are connected to a negative pressure source.

So as to simplify such compacting devices, allowing easy and fast installation on conventional drawing system units without requiring the installation of additional drive elements, PCT/CH2011/000280, which has not yet been previously published, proposes a design in which the compacting element in the form of a suction drum and the clamping roller are rotatably mounted on a shared support (support element), which is detachably attached to the spinning machine by way of attachment means. So as to establish a driving engagement between the drawing system rollers and the detachably attached compacting device, the compacting device is pivoted about a pivot axis in the direction of the delivery roller pair of the drawing system via the support element, wherein a respective friction wheel that is coaxially attached to the respective suction drum enters a frictional engagement (by way of friction) with the bottom roller of the delivery roller pair of the drawing system. The compacting device is held in this driving engagement by way of appropriately disposed spring elements (for example, on the weighting arm of the drawing system).

In the present example, the support element is provided for rotatably mounting two suction drums which are disposed coaxially and next to each other and which are attached downstream of two neighboring drawing system units, which are referred to as a twin drawing system. A twin drawing system shall be understood to mean two neighboring drawing system units, the pressure rollers of which are loaded by way of a shared pressure bar.

A suction channel for applying a negative pressure to the compacting elements is provided inside the support element (support). A first end of the suction channel is connected to the respective compacting element, and the second end thereof ends in the region of the support element at which the support element is attached to the spinning machine in the assembled position. The second end of the suction channel inside the support element forms a coupling point for connecting a further air channel, which is connected to a main channel. This means that, in the proposed design, the support element (support) serves both as a receptacle and bearing element for the compacting elements (for example, rotatably mounted suction drums having fixedly installed suction inserts) and as a channel for applying a negative air pressure to the corresponding suction inserts of the compacting units.

SUMMARY OF THE INVENTION

It is an object of the invention to simplify and improve the support element shown and described in PCT/CH2011/000280 comprising compacting devices for two drawing system units that are disposed next to each other, so as to ensure simplified and cost-effective production. In addition, the installation of the shaft that is attached to the support element for the rotatable mounting of the suction drums is to be simplified. Additional objects and advantages of the invention will be set forth in part in the following description, or may be obvious from the description, or may be learned through practice of the invention.

The objects are achieved by proposing to design the support element of two half shells that form the suction channel and that are connected to each other by way of attachment means, wherein each of the half shells comprises an outwardly projecting tubular suction insert, the suction inserts being disposed coaxially opposite each other, and each suction insert comprising at least one bearing element that is provided with a passage and comprises at least one brace, by way of which the shaft is held in the radial direction.

The expression "outwardly projecting suction insert" shall be understood to mean that the suction insert of the respective half shell extends transversely to the longitudinal direction and away from the suction channel of the half shell or of the conveying channel.

It is further proposed to provide the shaft with two end sections, which have a smaller diameter than a center region of the shaft, and to provide the passage of the bearing element of the respective suction insert with a step-shaped reduction of the inner diameter thereof, wherein the sections of the passages that are provided with the larger inner diameter coaxially adjoin each other and the center section of the shaft provided with a larger diameter than the reduced inner diameter of the passage is fixed inside the aforementioned mutually adjoining sections between stop surfaces of the respective step-shaped reduction of the passages in the axial direction.

The production of the support element is simplified as a result of the proposed design of the support element comprising two half shells that can be connected to each other, wherein it is made possible to produce the half shells as simple injection molded parts. At the same time, the tubular suction insert that is connected to the respective half shell can be produced in the same operation. When the two half shells are assembled, the suction inserts provided on the half shells are oriented coaxially with respect to each other. By appropriately providing a passage at the center of a receptacle of the respective suction insert mounting the shaft in the radial direction, the shaft, which is provided for rotatably mounting the suction drums, is also fixed in the axial direction when the two half shells are joined. The respective half shell of the support element and the suction insert associated therewith thus form a single-piece, stable unit.

Due to accordingly proposed design of the shaft, the diameter of which is reduced toward the ends thereof, the shaft can extend with the ends thereof through the passages of the bearing element of the suction inserts and is fixed in the axial direction thereof by way of the center portion, which has an enlarged diameter, between the mutually opposing sides of the step-shaped diameter reduction of the passages when the two half shells are joined. This is ensured by designing the diameter of the reduced passages smaller than the diameter of the center portion of the shaft. It is also conceivable to provide the bearing elements with depressions, which are provided coaxially with respect to the respective passage, for radial fixation of the shaft in the region of the step-shaped diameter reduction, wherein the base surface of the respective depression serves as a stop surface for the axial fixation of the center portion of the shaft and, in the circumferential direction of the depression, fixes the center portion of the shaft in the radial direction. This means that the diameter of the center portion of the shaft corresponds to the inner diameter of the depression and is held therein in the radial direction by way of adjustment of the play.

The proposed design of the support element allows a simple production method, while also simplifying the assembly of the elements connected to the support element (such as the shaft for the suction drums).

It is further proposed to provide the two half shells in each case with an opening associated with the respective suction drum for accommodating a respective extraction tube, wherein the center lines of the openings are oriented coaxially with respect to each other when the support element is assembled, and the coaxial shared axis of the same extends at a parallel distance from the axis of the shaft mounting the suction drums. The openings in each case open into an edge region of the suction channel.

Due to the proposed provision of the coaxially opposed openings for the extraction tubes in the edge region of the suction channel, the air current developing due to the negative pressure that is applied to the suction inserts is not adversely affected or influenced. The air currents developing due to the applied negative pressure via the extraction tubes in the direction of the channel center impinge on each other in the center region of the suction channel and are then deflected in the direction of the suction air current inside the suction channel. No fixed deflection edges for the air current suctioned in via the extraction tubes are thus present, whereby no friction losses can occur in the air guidance in this region.

Advantageously, it is further proposed to provide the respective half shell with webs projecting toward the center of the suction channel in the region of the openings for the extraction tubes, the webs extending axially and in extension of the respective opening on the side of the opening which faces the suction drums. This substantially blocks the air current flowing from the extraction tubes into the suction channel from the suction air current coming from the suction inserts. This means that the two suction air currents are not merged until the region in which the first suction air current coming from the suction inserts has already passed the webs projecting toward the center of the suction channel and in which the second air current coming from the extraction tubes has already been deflected in the direction of the first suction air current. Uncontrolled air turbulence inside the suction channel is thus prevented, as is the accumulation of dirt and fiber material in this region.

So as to ensure that no area is created between the mutually adjoining webs where individual fibers can become wedged when the two half shells are joined, it is proposed to provide a distance between the mutually adjoining surfaces of the webs which must be large enough to prevent fibers from becoming wedged at this area. This means that if fibers are transferred into this region by the suction air current, they can pass through the existing slot without becoming wedged. The extraction tubes are advantageously detachably attached on the respective opening. It is thus possible to replace differing extraction tubes with each other as needed. At the same time, the two half shells of the support element can be produced without taking complicated injection molds into consideration, which would be necessary if the extraction tubes were fixedly connected to the half shells.

As is further explained, in this way the center line of the respective extraction tube can extend at an angle with respect to the axis of the shaft carrying the suction drum, without impairing the production of the two half shells. Proceeding from the outer suction opening of the extraction tube, the distance between the respective extraction tube and the suction drum located opposite the extraction tube thus increases in the direction of the opening of the half shell. The clearance between the respective extraction tubes and the respective suction drum can thus be maintained large enough so that no deposits due to flying fibers can form in this region.

So as to orient the extraction tubes with respect to an oblique arrangement exactly on the intended extraction region of the respective suction drum, it is proposed to provide the extraction tubes with elevations and/or depressions, by way of which they form a form lock in the circumferential direction with elevations and/or depressions in the region of the opening of the half shell.

It is further proposed that the outer suction openings of the extraction tubes are located in planes which form an acute angle, viewed in the horizontal direction and in the extraction direction of the fiber channel, and move toward each other above the suction channel, viewed in the vertical direction.

These proposed suction openings, which are obliquely oriented in the space, achieve an optimal extraction action with respect to the flow of the yarn, whereby a broken thread end can be seized quickly and fed to the extraction channel. The extraction opening could preferably also still be partially located behind the flow of the yarn (viewed in the front view of the compacting device).

It is further proposed that the bearing elements of the two suction inserts of the half shells in each case comprise an additional radial brace for the shaft, which is provided in an adjacent manner in the region in which the half shells are seated against each other in the assembled position.

Due to the additional central radial bracing of the shaft by way of additional bracing elements in the bearing element, the two half shells are prevented from driving apart, which could occur due to the radial pressure forces acting on the suction drums.

So as to prevent the shaft from turning in the bearing element, it is further proposed that at least one of the radial braces in the half shells forms a form-locked connection with the shaft, viewed in the circumferential direction of the shaft. It is thus ensured that only the suction drums that are mounted by way of bearings on the shaft rotate, and that the shaft is stationary, so that no wear occurs between the shaft and the radial braces thereof in the bearing element.

To ensure that the suction air current generated by a suction source does not flow through the bearings containing grease in the region of the bearing mount of the suction drums, it is proposed to provide the shaft with a flattened region, which is oriented in the longitudinal direction, in the region of the bearing points for the respective suction drum for air to pass through. The suction air current can thus be conducted past the bearings lubricated with grease in the area of the flattened region of the shaft. Without such a bypass created by the proposed flattened region, it is possible for the grease to be pressed out of the bearings due to the suction air current, and grease may deposit on parts of the shaft or of the half shells. Fibers that are present in the suction air current may be retained in the regions to which the grease adheres, which can result in clogging.

For easy visual monitoring of the support element comprising the suction inserts attached thereto, it is proposed to produce the half shells from transparent plastic material.

Moreover a design is proposed in which the respective suction insert of the half shells is provided with a depression extending on the outer circumference of the suction insert, the depression being disposed in the region between the end face of the respective half shell with which the shells are seated against each other and the respective end face of the suction drum protruding over the suction insert.

This is intended to prevent flying fibers that may settle in the center region of the support element and other pollutants from reaching the radial annular gap between the respective suction drum and the suction insert. This means that the provided depression causes flying fibers to settle in this depression and they are prevented by the lateral delimitation of the depression from being displaced into the described annular gap in the axial direction to the respective suction drum. Due to cleaning cycles, which are carried out at regular intervals and during which the assemblies are cleaned manually or automatically by appropriate devices using compressed air, these deposits are removed before they can reach the respective annular gap.

Advantageously, lamellae-shaped graduations (tongue-and-groove principle) can be provided in the region of the surfaces with which the two half shells are seated against each other when they are joined (assembled) so as to block the suction channel formed by the two half shells from the ambient air. If necessary, it is also possible to insert circumferential sealing elements.

Instead of a screw connection between the two half shells, they can also be connected to each other by way of a bonded or welded connection.

Snap-fit connections having labyrinth-like sealing elements are also conceivable, which block the suction channel from the ambient air.

When the two half shells are joined, the respective suction inserts are also pressed against each other, whereby an inner space forms inside the suction inserts, which is connected to the suction channel on one side and to the respective suction slot on the other side. So as to delimit this inner space (air-guiding channel), radially outwardly directed webs extending in the longitudinal direction of the respective suction insert can be provided. These are advantageously disposed so that the inner space, which leads as an air guidance channel from the suction slots to the suction channel, extends behind the shaft, viewed from the front view. In this way, air that is suctioned in through the suction slots is directly supplied to the suction channel without further deflection, whereby the air can be extracted without interfering air vorteces.

Moreover, one embodiment for connecting the two half shells is proposed, wherein the two half shells are provided in each case with a peripheral flange, wherein—viewed in the assembled position of the two half shells—the flange of the second half shell partially protrudes over the first half shell, and the flange of the first half shell completely protrudes over the flange of the second half shell and forms a form-locked clamping connection therewith. This way a connection is obtained without the use of additional connecting means (such as screws, rivets or the like), while achieving sealing of the inner space with respect to the surroundings at the same time.

Advantageously it is further proposed that the flange of the second half shell is provided with an inwardly directed open receptacle in which the outer contour of the flange of the first half shell is accommodated in a form-locked manner, and, in the region of the clear protrusion of the flange of the first half shell, the flange of the second half shell is provided with an inwardly directed web, which partially protrudes over the flange of the first half shell.

It is further proposed that, in the assembled position of the two half shells, a gap that is open toward the direction of the inner space of the two half shells is provided between the end faces of the flanges of the half shells, the gap being blocked with respect to the outside by the flange of the first half shell.

BRIEF DESCRIPTION OF THE DRAWINGS

Further advantages of the invention will be shown and described in more detail based on the following exemplary embodiments.

In the drawings.

DETAILED DESCRIPTION

Figure 1:
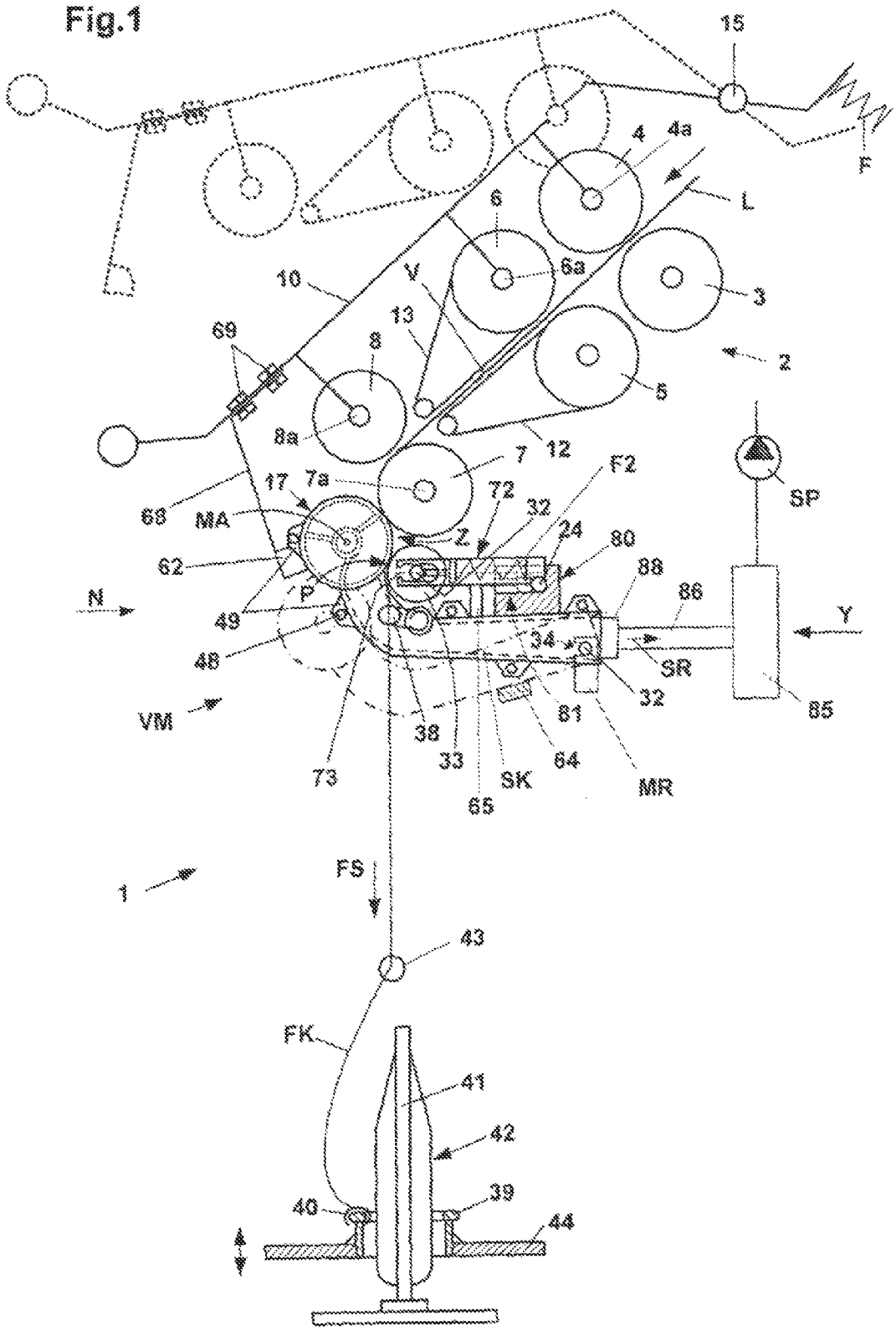
FIG. 1 shows a schematic side view of a compacting device attached to a support element, downstream of a drawing system.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a spinning station 1 of a spinning frame (ring spinning machine), comprising a drawing system unit 2, which is provided with a feed roller pair 3, 4, a middle roller pair 5, 6, and a delivery roller pair 7, 8. An apron 12, 13 is guided in each case around the middle rollers 5, 6, the aprons being held around a cage, which is not illustrated in detail, in their shown position. The top rollers 4, 6, 8 of the aforementioned roller pairs are designed as pressure rollers, by way of which the axles 4*a*, 6*a*, 8*a* are rotated mounted on a pivotably mounted pressure bar 10. The pressure bar 10 is mounted pivotably about an axle 15 and is acted on by a spring element F, as is shown schematically. The spring element can also be an air hose, for example. The rollers 4, 6, 8 are pressed against the bottom rollers 3, 5 and 7 or the roller pairs by the schematically shown spring load. The roller pairs 3, 5, 7 are driven by way of a drive, which is not shown. Individual drives, as well as other drive forms (gear wheels, toothed belts and the like), can be used. The pressure rollers 4, 6, 8 are driven via the driven bottom rollers 3, 5, 7, and the apron 13 is driven via the apron 12, by way of friction. The circumferential speed of the driven roller 5 is slightly higher than the circumferential speed of the driven roller 3, so that fiber material, in the form of a sliver, fed to the drawing system unit 2 is imparted a preliminary draft between the feed roller pair 3, 4 and the middle roller pair 5, 6. The main draft is imparted to the fiber material L between the middle roller pair 5, 6 and the delivery roller pair 7, 8, wherein the delivery roller 7 has a considerably higher circumferential speed than the middle roller 5.

Figure 4:
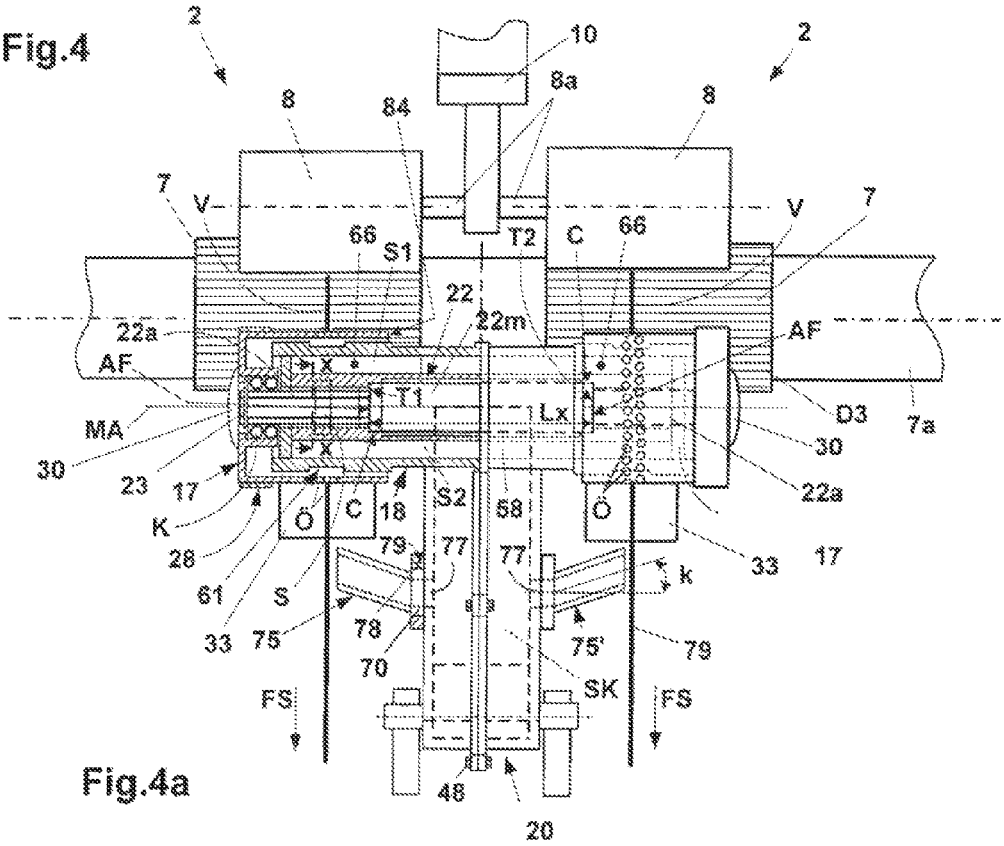
FIG. 4 shows an enlarged partial view N according to FIG. 1.

As can be seen from FIG. 4 (view N according to FIG. 1), two adjoining drawing system units 2 (twin drawing system) are associated with one pressure bar 10. Since these are identical elements, or elements disposed in part laterally reversed, of the neighboring drawing system units or compacting devices, identical reference numerals are used for these parts.

The drafted fiber material V discharged from the respective delivery roller pair 7, 8 is deflected downward and reaches the region of a suction zone Z of a downstream suction drum 17. The respective suction drum 17 is provided with perforations or openings Ö on the circumference thereof. An annular suction insert 18 is disposed in each case inside the suction drum 17, which is rotatably mounted on a shaft 22 by way of a bearing K. As can be seen schematically from FIG. 2 and FIG. 3 and will be described hereafter, the respective suction insert 18 is an integral part of each half shell H1 or H2, wherein the two half shells form a support element 20 when they are assembled. The first half shell H1 is composed of a profiled pivot section 55 that is open on one side and an outwardly projecting suction insert 18, which is fixedly connected to the profiled pivot section. The second half shell H2 comprises a profiled pivot section 56, which opens into a suction insert 18 connected to the profiled pivot section. The suction inserts 18 are oriented transversely to the longitudinal direction of the respective half shell H1, H2. The profiling of the respective half shell H1 or H2 is designed so that they can be produced completely in an injection mold. It is thus possible to optimally design the air-guiding regions without sharp-edged transitions, wherein deposits of pollutants inside the air-guiding regions are virtually precluded.

Figure 3:
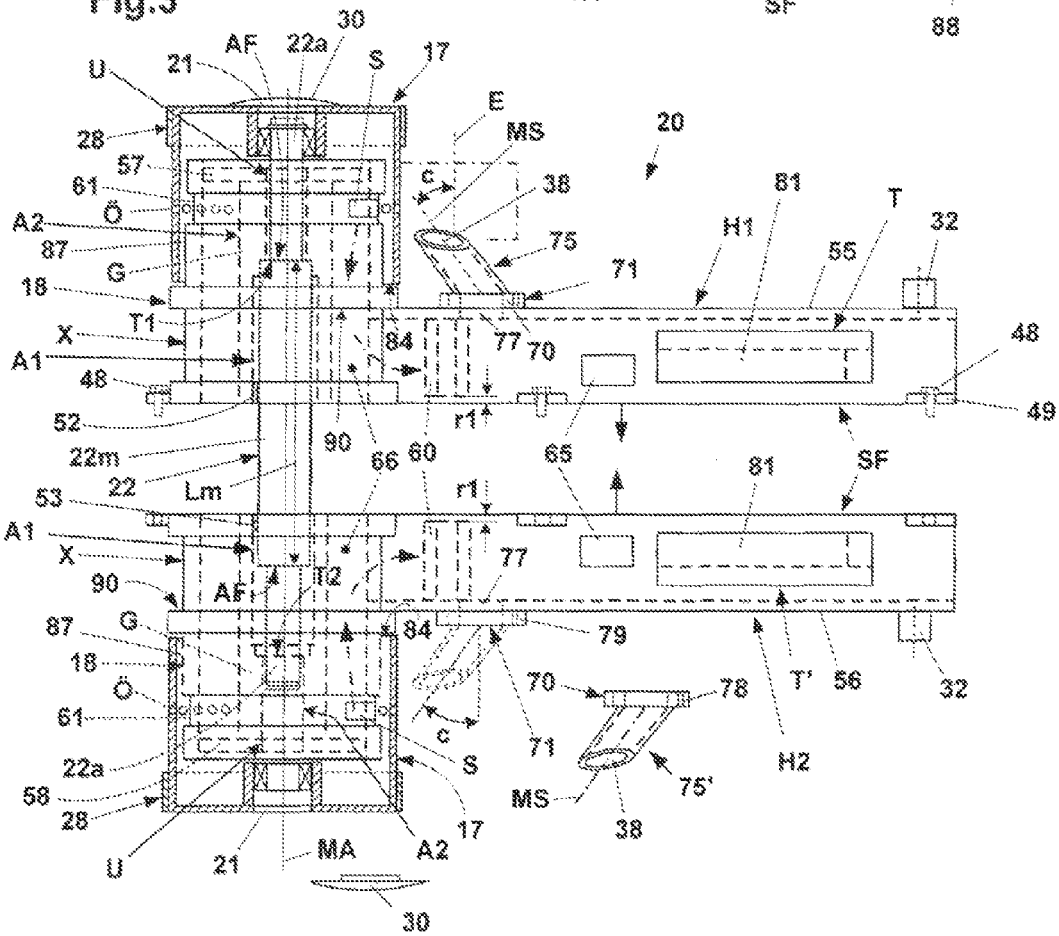
FIG. 3 shows a top view according to FIG. 2, comprising the two half shells of the support element and the suction drums mounted on the support element prior to joining.
Figure 7:
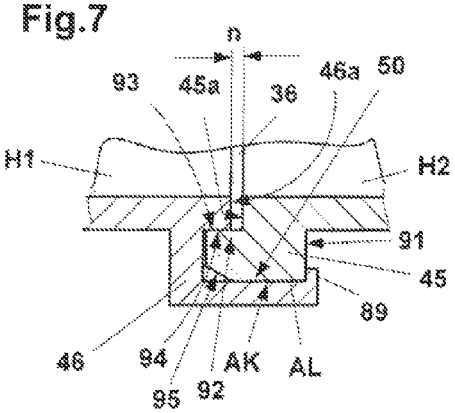
FIG. 7 shows an enlarged partial view according to FIG. 5.

FIG. 3 shows the joining (assembly) of the two half shells H1, H2 in the direction of the arrow to form a support element 20. By joining the profiled pivot sections 55, 56 of the two half shells H1, H2, the sections being open on one side, a suction channel SK that is closed on all sides is formed (FIG. 1, FIG. 4). The end faces SF of the two half shells H1, H2 are then seated against each other and are pressed against each other by way of multiple screw connections 48, which are distributed over the length of the two half shells. In the region of the screw connections, the half shells are provided with a respective web 49, each web having a through-hole for the screws 48. The end faces SF can be provided with elevations and depressions (not shown), which together result in a labyrinth-like sealing site. Likewise, additional sealing elements (not shown) can be provided between the end faces SF for sealing the suction channel SK that is formed. It is further possible to connect the two half shells H1, H2 to each other by way of bonded or welded connections. Instead of the screw connections 48, it is also possible to use other mechanical connecting elements, such as rivets or the like. A snap-fit connection can also be present in the region of the end faces. For this purpose, the half shells H1, H2 must be provided with appropriately designed end faces in this region. This will be described in more detail in one exemplary embodiment, which is shown in FIG. 7.

Figure 2:
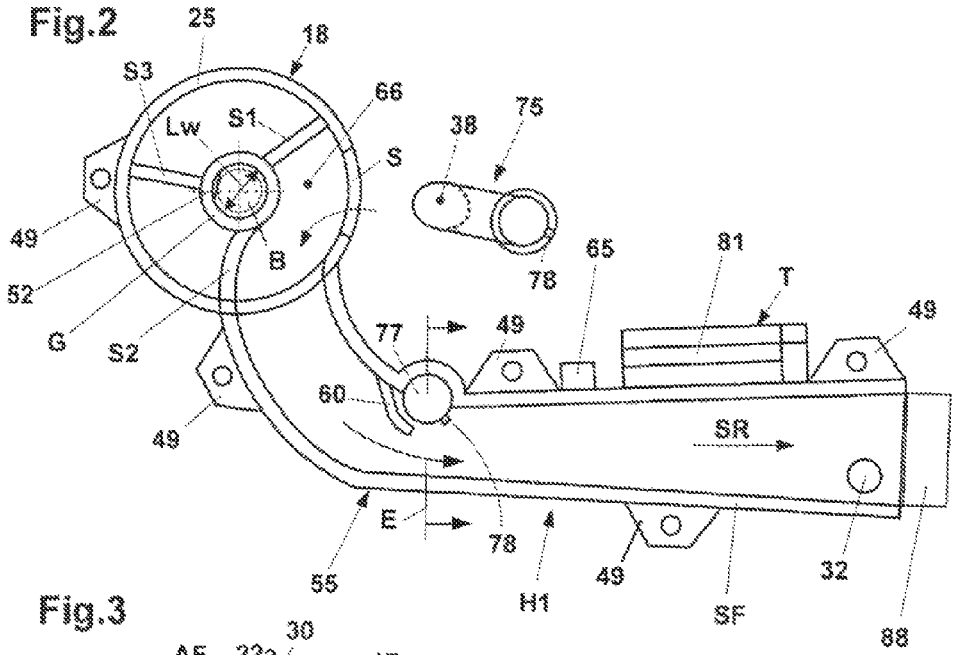
FIG. 2 shows an enlarged side view of a half shell of the support element of FIG. 1 designed according to an embodiment of the invention.

When the two half shells H1, H2 are joined, the respective suction inserts 18 are also pressed against each other, whereby an inner space 66 forms, which is connected to the suction channel SK on one side and to the respective suction slot S on the other side. So as to delimit the air-guiding channel 66, radially outwardly directed webs S1, S2 extending in the longitudinal direction of the respective suction insert 18 are provided, which are connected in each case with a tubular hub G that is provided at the center of the respective suction insert 18 and has a centric opening B. This is schematically illustrated in FIGS. 2, 3 and 4. In the case of the half shell H1, the hub G extends between the end face SF and a radially oriented web 57, which is provided within and in the region of the free end of the suction insert 18. The web 57 is provided with a centric through-passage U. In the case of the half shell H2, the hub G extends between the end face SF and a radially oriented web 58, which is provided within and in the region of the free end of the suction insert 18. The web 58 is likewise provided with a centric through-passage U. The shaft 22 is mounted in the region of the opening B and of the through-passages U, the shaft comprising a center portion 22*m*, to the two ends of which a respective end piece 22*a* connects, the end pieces having a smaller diameter than the center portion 22*m*.

Outside of the existing radial bearing points, the inner diameter Lw of the opening B of the respective hub G is greater than the outside diameter of the respective sub-section 22*m*, 22*a* of the shaft 22. The respective hub G comprises a longitudinal section A1 of the opening O on which a longitudinal section A2 borders, the inner diameter Lw of which is smaller than the inner diameter Lw of the section A1 and the diameter of the sub-section 22*m* of the shaft 22. When the half shells H1, H2 are assembled, the two sections A1 of the respective suction inserts 18 directly adjoin each other. A respective step-shaped depression C (shoulder) is provided in the region of the transitions between the sub-sections A1 and A2 of the opening 0, the center portion 22*m* of the shaft 22 being fixed in the radial direction in this depression. This means that the inner diameter Lw of the depression C corresponds to the diameter of the center portion 22*m* of the shaft.

Figure 4A:
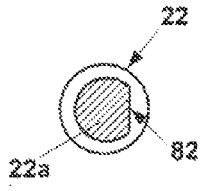
FIG. 4*a* shows a sectional illustration x-x of the shaft 22 according to FIG. 4.

FIG. 4*a* shows a cross-cut view of the shaft 22 along line x-x of FIG. 4. The shaft 22 includes a longitudinally extending flattened region 82 at bearing points with the suction drum for air to pass through.

The inner space 66, which extends as an air guidance channel from the suction slots S to the suction channel SK, extends behind the shaft 22 or the hub G, viewed from the view N (FIG. 1). In this way, air that is suctioned in through the suction slots is directly supplied to the suction channel SK without further deflection, whereby the air is extracted without interfering air vorteces. A further web S3 can be provided to reinforce the suction insert 18 (FIG. 2).

FIG. 2 shows a side view of one of the half shells H1. An extraction tube 75, which is attached to the half shell H1 in the region of the opening 77, is shown separately. As is apparent from the illustration of FIG. 3, proceeding from the attachment point of the extraction tube in the assembled state, the center line MS of the extraction tube 75 extends obliquely and at an angle c with respect to a vertical plane E, which runs parallel to a vertical plane that is placed through the center line MA of the suction drum 17. The suction pipe 75', which is attached to the second half shell H2, has a laterally reversed design and likewise extends at an angle c with respect to the center line MA, viewed in a horizontal plane. Due to the provided oblique arrangement of the respective extraction tube, the space remaining clear between the respective extraction tube 75, 75' and the adjoining suction drum 17 is so large that no pollutants can accumulate in this clearance. However, it is ensured that the extraction action takes place optimally since the openings of the extraction tubes extend as close to the flow of the yarn as possible. As is apparent from the view of FIG. 4 and FIG. 5, the extraction tubes 75, 75' can additionally extend at an angle k with respect to the center line of the suction drums 17, viewed in the horizontal direction. As is shown schematically in FIG. 4 and FIG. 3, the extraction tube 75 (and also the extraction tube 75') comprises a flange 70, which is provided with a cam 78. This cam 78 fixes the respective extraction tube 75, 75' in the circumferential direction in the installed position of the same. To this end, the respective cam 78 protrudes into a recess 79 of the respective half shell H1, H2, which is provided in the region of the openings 77. The separate installation of the extraction tubes makes it possible to replace these with others, depending on the requirements. Additionally, the oblique orientation of the extraction tubes must not be taken into consideration when generating the injection molds for producing the half shells H1, H2, whereby the injection mold can have a simple and cost-effective design.

Figure 6:
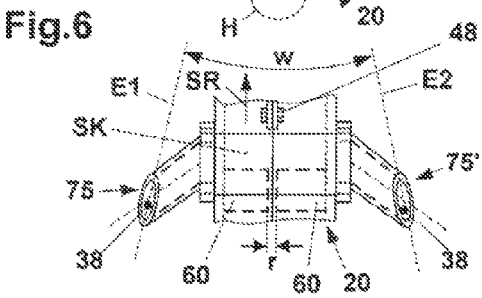
FIG. 6 shows a partial view of the extraction tubes according to FIG. 3 in the mounted state.

As is apparent from FIG. 2 and FIG. 3, the respective opening 77 is blocked by a web 60 extending transversely to the suction channel from the suction inserts 18 and the suction air current, which is indicated with an arrow. This prevents a collision of the two suction air currents (from the suction inserts 18 and the extraction tubes 75, 75') in the region of the openings 77, which could result in air turbulence. As soon as uncontrolled air currents develop inside a suction channel, there is a risk that pollutants can settle in this region, which can ultimately cause the suction channel to become clogged. However, this was prevented by the proposed provision of the webs 60. There is a distance r1 between each of the webs 60 (FIG. 3) and the respective end face SF, whereby a distance r forms between the webs 60 when the two half shells are connected to each other. This is shown schematically in the partial view of FIG. 6, for example. If no distance r were provided, a sharp edge or a narrow slot could form between the two webs 60 when the two half shells H1, H2 are joined, and fibers could cling thereto or become wedged therein. So as to preclude this, a gap having a distance r is provided from the start, which is so large that fibers reaching this region are able to pass the gap.

As is schematically indicated in FIG. 3 and FIG. 4, the respective suction insert 18 has a suction slot S, which extends essentially over the suction zone Z, in a sub-region of the circumference. Moreover, the respective suction insert 18 is provided with a peripheral depression 61 in the region of the slot S so as to keep the impurities and fibers reaching the inner space of the respective suction drum 17, for example via the suction air current via the openings Ö, in the region of the suction slot S, by way of which they can then be extracted and fed to a central collection point. In this way, deposits from dust and fibers inside the suction drum are to be prevented.

The respective suction drum 17 is rotatably mounted in the region of the outer end thereof on an end piece 22*a* of the shaft 22 by way of a bearing K. The mutually opposing end pieces 22*a* of the shaft 22 have a smaller diameter than the center portion 22*m* of the shaft 22, so that a shoulder having a stop surface AF is formed between the center portion 22*m* and the adjoining end pieces 22*a*. So as to axially fix the suction drum 17 on the shaft 22, a retaining ring 23 is provided in a groove of the shaft, the retaining ring suppressing the axial displacement of the suction drum during the operation. An opening 21, which can be closed by a cover cap 30, is provided in the center of the respective suction drum 17. By removing the retaining ring 23 after the cover cap 30 has been pulled off, it is possible to easily pull the respective suction drum 17 off the end piece 22*a* of the shaft 22 in the axial direction. This allows fast replacement of the suction drums 17 so as to optionally replace these with other suction drums having a different arrangement of the openings Ö in order to retool the compacting element for processing a different fiber material. The respective suction drum can also be removed only for cleaning purposes. The retaining ring can also be an O-ring made of rubber or a flexible locking ring, for example.

When the two half shells H1, H2, or the suction inserts 18 provided on the half shells, are joined in accordance with FIG. 3, the shaft 22 is fixed in the axial and radial positions. To this end, the shaft 22 is fixed by way of the center portion 22*m* thereof having a length Lm between the stop surfaces T1 and T2 of the depressions C. When the two suction inserts 18 are joined (FIG. 4), the distance Lx between the stop surfaces T1, T2 of the depressions C is only slightly larger than the length Lm of the center portion 22*m* of the shaft 22. The shaft is thus fixed in the axial direction inside the suction inserts 18, wherein the end pieces 22*a* of the shaft 22 in each case protrude through the openings U of the webs 57, 58 onto which the suction drums 17 are pushed via the bearings K. As was already described, in the region of the stop surfaces T1, T2 of the depressions C are provided for radially mounting the shaft 22, the inner diameter of the depressions corresponding to the diameter of the central shaft section 22*m*. The outer circumferential surface of the shaft section 22*m* is thus seated on the inner circumferential surface of the depression C and is thus fixed in the radial direction.

In the region of the separating point of the two half shells H1, T2, the two suction inserts 18 can be provided with additional braces 52, 53 which protrude into the respective opening B and on which the center portion 22*m* of the shaft 22 can be braced in a certain radial direction. These braces are only provided on a partial circumferential region of the opening and oriented in keeping with the force actions that occur. The braces 52, 53 can also be formed in this region by appropriately shaping the cross-section of the opening B.

It is thus ensured that the radial forces that act on the suction drums 17 and are transmitted to the shaft 22 via the bearings K are absorbed by the braces 52, 53 or the respective hub G. It is thus prevented that the two suction inserts 18 can drift apart in the region of the separating point of the two half shells due to the bending torque that is created.

After the two half shells H1, H2 have been assembled, while also fixing the shaft 22, the shells are screwed together by way of the screw connections 48. Thereafter, the suction drums are pushed onto the shaft ends 22*a* via the bearings K and are axially secured in each case by a retaining ring 23, which engages in a schematically indicated groove of the respective shaft end. Access to the shaft end is provided via a central opening 21 of the respective suction drum 17.

After the suction drum has been secured, the openings 21 are closed by a schematically illustrated elastic cap 30.

Thereafter, the two extraction tubes 75, 75' are fixed in the region of the openings 77. The extraction tubes 75, 75' comprise a flange 70 at one end, the flange in the region of the circumferential surface thereof being provided with a cam 78 pointing outwardly in the radial direction. The outside diameter of the respective flange 70 corresponds approximately to the inside diameter of the flange 71 that is provided on the respective half shell H1, H2 centrically with respect to the opening 77. In the region of the inner circumferential surface of the flange 71, a radially outwardly projecting recess 79 is provided, the outer contour of which corresponds to the contour of the cam 78. The cams 78 and the recess 79 thus form a form-locked connection when the flange 70 of the respective extraction tube 75 or 75' is introduced into the opening of the flange 71, wherein the cam 78 and the recess 79 are disposed opposite each other. The respective extraction tube is thus fixed viewed in the circumferential direction and assumes the desired angular position having the angle c with respect to the respective suction drum 17. By an appropriately selected dimensional configuration of the flanges 70, 71, the extraction tubes 75, 75' are maintained in the installed positions thereof by way of a light press fit. However, other attachment means can also be used to maintain the assembled extraction tubes in the installed positions thereof.

Downstream of the suction zone Z, a clamping roller 33 is provided for each of the suction drums 17, the clamping roller being seated on the respective suction drum 17 by way of a pressure load and forming a clamping line P therewith. The respective clamping roller 33 is rotatably mounted on an axle 32 for this purpose, which is held in a guide slot 73 of a U-shaped receptacle of a pressure bar 72. The axle 32 is mounted inside the guide slot 73 so as to be displaceable transversely to the longitudinal axis thereof. A ram, which is seated on the outer circumference of the axle 32 and which is acted upon by a schematically indicated compression spring F2, extends through an opening of the pressure bar into the guide slot. The opening is provided approximately centrally at the end of the guide slot 73 and opens into a substantially closed cavity of the pressure bar 72, in which the compression spring is disposed. The spring is supported on the closed end of the cavity with one end and is seated on a head of the ram with the opposing end.

The pressure bar 72 is mounted pivotably about an axle 24 attached to the end of the bar in a bearing element 80, as can be seen schematically from FIG. 1. The bearing element 80 is formed of webs T or T', which are provided on the half shells H1, H2 and which each comprise a guide 81, via which the axles 24 of the pressure bar 72 are transferred into the pivoted positions thereof shown in FIG. 1 when the two half shells H1, H2 are connected to each other. In this pivoted position, the axles 24 are held transversely to the pivot axes thereof at the end of the respective guide 81 via a stop edge, which is shown schematically in FIG. 1. By way of the force of the compression spring F2, the clamping rollers 33 rotatably supported on the pressure bar 72 are then loaded against the respective suction drum 17, whereby a clamping line P is created. The pressure bar is pivoted over a dead center until it is seated on a stop 65, which is provided at the respective half shells H1, H2. In this position, the axle 32 of the clamping rollers 33 is located below the plane that extends through the pivot axle 24 and the center line MA of the suction drums 17. This means, the clamping roller 33 is held in this position via dead center. Further details regarding the attachment and design of the clamping rollers 33 can also be found in CH-01242/11, which has not been previously published and was filed in Switzerland on Jul. 25, 2011.

The compacting device VM is now pre-assembled and is then attached to the respective drawing system 2 (twin drawing system) on the spinning machine. The support element 20 is introduced with the axles 32 that are provided on the profiled pivot sections 55, 56 of the half shells H1, H2 into receptacles 34 on the machine frame MR and is held in this pivoted position, shown in FIG. 1, by way of clamping elements or other means, which are not shown. As is with dash-dotted lines, the compacting device VM can pivot via the pivot axles 32 into a bottom position until it is seated on a stop 64 provided on the machine frame MR and held in place there.

For the transfer into the working position shown in FIG. 1, the compacting device VM is pivoted about the axles 32 into an upper position until the friction rings 28 (friction wheel) provided on the respective suction drum 17 are seated on the respective driven roller 7 of the feed roller pair of the drawing system 2.

Thereafter, the pressure lever 10 is pivoted about the pivot axle 15 from a top position shown with dotted lines (FIG. 1) into a bottom position, in which a pressure force is exerted on the support element 20 of the compacting device VM in the direction of the roller 7 via a plate spring 68, which is attached to the pressure lever 10 by way of screws, and the web 62 attached to the plate spring. The respective friction ring 28, and thus the suction drum 17 connected thereto, are thus driven by way of friction by the roller 7. The friction ring 28 can be made of an elastic material, such as rubber.

In this "operating position", the fiber material that has been drafted by the drawing system 2 and discharged is fed to the downstream suction zone Z of the respective suction drum 17 and condensed in the known manner under the influence of the suction air current that is generated. Above the suction zone, a deflection shield disposed at a distance may also be provided, as is shown and described in DE 44 26 249. This publication also describes the procedure of condensing the fiber material.

So as to generate the required negative pressure in the region of the suction zone Z, a negative pressure source SP is provided, which is connected to a central extraction channel 85. The extraction channel 85 is connected via a pipe 86 and a flexible coupling element 88 to the respective end of the suction channel SK of the compacting device VM projecting in the direction of the extraction channel 85. The flexibility of the coupling element 88 enables pivotability of the compacting device about the axle 32. The schematically shown coupling element 88 can be designed on the outer circumference in such a way that it is connected to the suction channel SK that is formed in a form-locked and outwardly sealed manner when the two half shells H1, H2 are joined.

At the same time, the clamping line P generated by the clamping roller 33 forms a so-called "twist stop gap" from which the fiber material is fed in the conveying direction FS in the form of a compact yarn FK to a schematically shown ring spinning device while being imparted a twist. This device is provided with a ring 39 and a traveler 40, wherein the yarn is wound onto a tube 41 to form a bobbin 42 (*cop*). A thread guide 43 is disposed between the clamping line P and the traveler 40. The ring 39 is attached to a ring frame 44, which carries out an up and down movement during the spinning process.

In the event of a yarn break between the clamping line P and the bobbin 42, the yarn FK that continues to be delivered via the clamping point P is extracted via the respective extraction tube 75 or 75' which is attached to the support element 20 through the opening 77 under the action of the negative pressure generated by the negative pressure source SP via the suction channel SK and is fed to the extraction channel 85. The respective extraction opening 38 of the extraction tubes 75 or 75' is laterally associated with the flow of the yarn.

A respective depression X is provided on the circumferential surface of the respective suction insert 18 in the region between the end faces SF with which the two half shells H1, H2 are seated against each other and the end faces 84 of the suction drums 17. This creates a step-shaped shoulder 90 in each case in the region of the end faces 84 of the suction drums 17, which prevents flying fibers that have accumulated in the center region of the support element 20 from being able to be displaced into the gap 87 between the suction drum 17 and the suction insert 18. This means that the respective step-shaped shoulder 90 represents a barrier for the lateral displacement of deposits. Such deposits are then removed in time through cleaning intervals before they are able to overcome the described barrier.

Figure 5:
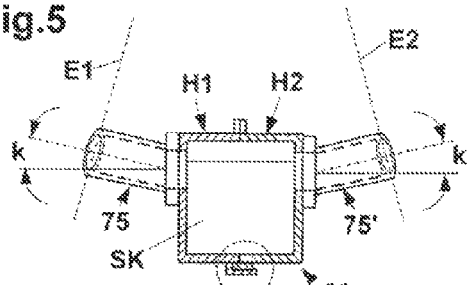
FIG. 5 shows a partial view of a sectional illustration in the plane E according to FIG. 2.

A further embodiment with respect to the connection of the two half shells H1, H2 is shown in FIG. 5 (view H), which is shown in more detail as an enlarged partial illustration in FIG. 7. The two half shells H1, H2 comprise peripheral flanges 45, 46 at the ends, by way of which the two half shells are connected to each other in a form-locked manner without additional means (such as pins, screws or the like). At the same time, the embodiment shown here blocks the inner space of the suction channel SK and the inner region of the suction inserts 18 from the surroundings, without necessitating additional sealing means in the region of the connecting sites.

The flange 45 of the first half shell H2 is provided with an inwardly directed shoulder 92, the inner surface 93 of which partially extends over the outer surface 94 of the half shell 91 and rests thereagainst in the assembled position. Moreover, a flange 46, which extends completely over or covers the flange 45 on the outer surface AL of the same, is provided on the half shell H1. The flange 46 has an L-shaped cross-sectional surface, which forms an inwardly directed receptacle 50 by way of which the flange 46 forms a form-locked connection with the flange 45 in the shown assembled position. The term "inwardly" refers to the inner space of the assembled half shells H1, H2.

At the end of the L-shaped cross-section, the flange 46 is provided with an inwardly projecting web 89, which partially protrudes over the rear surface 91 of the flange 45 and holds the flange 45 in the shown locking position thereof in the receptacle 50 of the flange 46. This means that force must be exerted if the connection is to be detached so as to deflect the L-shaped section of the flange 46 outwardly using the elasticity that is present, until the web 89 is located outside the surface 91 and thus allows the flange 45 to exit the receptacle 50.

To facilitate assembly, the flange 46 is provided with a chamfer 95.

So as to avoid a sharp edge in the region of the connecting site between the half shells H1, H2 or between the flanges 45, 46 thereof, a gap 36 having the distance n is provided between the surfaces 45*a* and 46*a* of the flanges 45, 46. This prevents fibers from being able to settle in this region. The gap 36 is blocked with respect to the outside from the ambient air by the inner surface 93 of the flange 45.

The proposed design, in which the support element 20 of the compacting device VM is produced from two half shells H1, H2 having integrated suction inserts 18, not only allows simple and cost-effective manufacture, but also ensures easy assembly, wherein an optimal function with regard to loss-free air guidance inside the support element is assured.

Modifications and variations can be made to the embodiments illustrated or described herein without departing from the scope and spirit of the invention as set forth in the appended claims.

The invention claimed is:

1. A support element for a compacting device for two drawing system units disposed adjacent each other in a spinning machine, wherein each drawing system has a suction drum operably associated with a delivery roller pair, the suction drums coaxially arranged with open facing end faces, each suction drum having a suction zone, the support element comprising:

two half shells connected to each other at respective end faces to define a suction channel;

each of the two half shells comprising an outwardly projecting tubular suction insert, wherein the suction inserts are coaxially adjoined to each other;

the suction channel connected to the suction zone of each suction drum via the suction inserts;

each suction insert comprising a bearing element having a passage and a brace; and wherein the suction drums are rotatably mounted on a shaft that is supported by the support element, the shaft disposed through the passage in the suction inserts and radially fixed by the brace of the suction inserts.

2. The support element as in claim 1, wherein the shaft comprises opposite end sections having a smaller diameter than a center region of the shaft, the passage of each suction insert having a step-shaped inner diameter that reduces from a larger diameter section to a smaller diameter section, the center region of the shaft accommodated in the adjoined larger diameter sections of the suction inserts and axially fixed in position by the step-shaped reduction from the larger diameter sections to the smaller diameter sections of the passage.

3. The support element as in claim 1, wherein each of the two half shells comprises an opening that accommodates an extraction tube, the openings having coaxial centerlines that are parallel to and at a distance from an axis of the shaft, the openings opening into the suction channel.

4. The support element as in claim 3, wherein each of the two half shells comprises a web that projects from a side of the opening facing the suction drums towards a center of the suction channel.

5. The support element as in claim 4, wherein the webs are aligned and there is a space between the webs.

6. The support element as in claim 3, further comprising an extraction tube detachably attached to each of the openings.

7. The support element as in claim 6, wherein a centerline of each extraction tube extends at an angle relative to the axis of the shaft such that an outer end opening of the extraction tube is closer to the suction drums than an opposite end of the extraction tube connected to the opening in the half shell.

8. The support element as in claim 7, further comprising a circumferential lock between the extraction tube and the opening in the half shell formed by an engaging elevation and depression between the extraction tube and the opening.

9. The support element as in claim 7, wherein the outer end opening of the extraction tubes are disposed in respective planes above the suction channel that form an acute angle relative to each other in an extraction direction of the suction channel.

10. The support element as in claim 1, wherein the bearing element of each of the suction inserts comprises an additional radial brace for the shaft at a location where the two half shells are connected to each other.

11. The support element as in claim 10, wherein the additional braces form a circumferential form-locked connection with the shaft.

12. The support element as in claim 10, wherein the shaft comprises a longitudinally extending flattened region at bearing points with the suction drums for air to pass through.

13. The support element as in claim 1, wherein the two half shells are made of a transparent plastic material.

14. The support element as in claim 1, wherein each of the suction inserts comprises a depression on an outer circumference of the suction insert between the end face of the respective half shell and a respective end face of the suction drum that protrudes over the suction insert.

15. The support element as in claim 1, wherein the two half shells are each provided with flanges at the end faces thereof that define a form-locking clamping connection between the end faces.

* * * * *